US012733699B2

(12) United States Patent
Baker et al.

(10) Patent No.: US 12,733,699 B2
(45) Date of Patent: Sep. 15, 2026

(54) MULTIPLE LAYER GLOVE AND METHOD OF MANUFACTURE

(71) Applicant: Bakner Products, LLC, Canton, GA (US)

(72) Inventors: Jason Alan Baker, Hawkins, TX (US); Matthew Lawrence Wagner, Canton, GA (US)

(73) Assignee: BAKNER PRODUCTS, LLC, Canton, GA (US)

( * ) Notice: Subject to any disclaimer, the term of this patent is extended or adjusted under 35 U.S.C. 154(b) by 87 days.

(21) Appl. No.: 18/687,488

(22) PCT Filed: Aug. 30, 2022

(86) PCT No.: PCT/US2022/042014

§ 371 (c)(1),
(2) Date: Feb. 28, 2024

(87) PCT Pub. No.: WO2023/034285

PCT Pub. Date: Mar. 9, 2023

(65) Prior Publication Data

US 2024/0349831 A1 Oct. 24, 2024

Related U.S. Application Data

(60) Provisional application No. 63/238,806, filed on Aug. 31, 2021.

(51) Int. Cl.

| | |
|---|---|
| ***A41D 19/00*** | (2006.01) |
| ***A41D 19/015*** | (2006.01) |
| ***A41D 19/04*** | (2006.01) |

(52) U.S. Cl.

CPC ... *A41D 19/0006* (2013.01); *A41D 19/01505* (2013.01); *A41D 19/01529* (2013.01); *A41D 19/043* (2013.01)

(58) Field of Classification Search

CPC ..... A41D 19/0006; A41D 19/015; A41D 19/01505; A41D 19/01529; A41D 19/043

(Continued)

(56) References Cited

U.S. PATENT DOCUMENTS

| | | | |
|---|---|---|---|
| 4,036,415 | A | 7/1977 | Filko et al. |
| 7,803,438 | B2 | 9/2010 | Flather et al. |

(Continued)

FOREIGN PATENT DOCUMENTS

| | | |
|---|---|---|
| CN | 107788661 | 3/2018 |
| CN | 208523848 | 2/2019 |

(Continued)

OTHER PUBLICATIONS

PCT International Search Report, PCT/US2022/042014, Dec. 23, 2022, 4 pages.

(Continued)

*Primary Examiner* — James D Sells

(74) *Attorney, Agent, or Firm* — Baker Donelson; Carl M. Davis, II

(57) ABSTRACT

A glove (10) with a first glove (12) rollingly attached to a second glove (16) having a tacky adhesive coating (14) during an open time between application of the adhesive coating and cure, which bondingly secures the first and second gloves together. A glove assembly apparatus (40) having a first form (50) for receiving a first glove (12), said first form (50) having five spaced-apart digital carriers (52) for receiving a respective digital portion of the first glove (12), and a second form (22) for receiving a second glove (16), said first form (50) movable relative to the second form (22) to roll the digital portions of the first glove (12) into contact with a tacky open adhesive coating layer on the second glove (16), and an apparatus for applying the adhesive coating, so that the first glove and the second glove (Continued)

bond together upon cure of the adhesive coating. A method of assembling a first glove to a second glove is disclosed.

24 Claims, 6 Drawing Sheets

(58) Field of Classification Search
USPC ..... 156/245
See application file for complete search history.

(56) References Cited

U.S. PATENT DOCUMENTS

| | | | | |
|---|---|---|---|---|
| 7,959,758 | B2 | 6/2011 | Flather et al. | |
| 9,072,325 | B2 | 7/2015 | Ragan | |
| 9,877,528 | B2 | 1/2018 | Hassan | |
| 10,010,124 | B2 | 7/2018 | Kishihara | |
| 2009/0077713 | A1 | 3/2009 | Saunders | |
| 2017/0099892 | A1* | 4/2017 | Palese ..... | A41D 19/01529 |

FOREIGN PATENT DOCUMENTS

| | | | |
|---|---|---|---|
| DE | 000019952480 | A1 | 5/2001 |
| EP | 1251756 | B1 | 9/2004 |
| EP | 3075275 | B1 | 10/2018 |
| WO | 2010107297 | A2 | 9/2010 |

OTHER PUBLICATIONS

PCT Written Opinion of the International Searching Authority, PCT/US2022/042014, Dec. 23, 2022, 5 pages.

* cited by examiner

MULTIPLE LAYER GLOVE AND METHOD OF MANUFACTURE

CROSS REFERENCE TO RELATED APPLICATION

This application claims the benefit of U.S. Provisional Patent Application No. 63/238,806 filed Aug. 31, 2021, entitled "Gloves & Method Of Manufacture", and the disclosure of which is incorporated herein by reference in its entirety.

BACKGROUND OF THE INVENTION

Multiple glove manufacturing technologies exist to produce various types of gloves. One technique includes knitting gloves with textiles to give desired properties. Other techniques include dipping gloves with or without textile liners to provide properties such as grip, chemical resistance, and increased durability. Typical multi-functional gloves are offered with at least one but typically combinations of multiple use requirements:

- Chemical resistant
- Cut resistant
- Thermal protection (cold and heat)
- Liquid resistant
- Abrasion resistant
- Puncture resistant
- Tear resistant
- Moisture absorbent (i.e., sweat)
- Moisture wicking (transfer moisture to an absorbent layer)

Many industrial and heavy equipment operations and applications require a work glove with multiple properties. An example of this is a glove that is both chemical and cut resistant. Current manufacturing techniques are limited when multiple properties are required. For example, dipping a cut resistant liner with a polymer for chemical resistance is limited due to polymer penetration, which makes the glove unusable, stiff, and uncomfortable. The resulting glove is often compromised with respect to performance and can result in reduced cut resistance or reduced chemical resistance.

Available techniques for glove manufacture include bonding multiple gloves made by different processes. Some current market products are manufactured with a complex robotic receiving mould and air inflation bonding technology. The drawbacks to such apparatus and method include the complexity, cost and difficulty in operation. For example, a multiple function glove manufactured with a current process uses air pressure inflation during the bonding of an inner liner layer and an exterior functional glove. The inner liner layer is a receiving glove that receives the exterior functional glove. The assembly process applies an adhesive to the liner, or receiving glove. The liner then receives the second layer, or exterior functional glove. A nozzle coupled to a supply of pressurized air injects pressurized into the cavity of the liner glove assembled to the exterior glove. The air pressure inflates the assembled liner glove and exterior glove for pressing the liner glove against the exterior glove. The pressurized assembly is heated to activate the adhesive and bond the two layer together as an assembled glove. Challenges to bonding multiple layers include the mechanics of bringing the multiple layers together into a usable glove. Challenges include getting the complex 3-dimensional geometry including fingers and crotches together without wrinkling. The tacky surface of the receiving glove increases the complexity since the additional layer will not easily slide across the tacky surface.

Accordingly, there is a need in the industry for an improved method and apparatus for assembling a first layer glove and a second layer glove as a multi-layer glove. It is to such that the present invention is directed.

SUMMARY OF THE INVENTION

This invention meets the need in the art by providing a novel mechanical process that brings two gloves of a liner and an exterior together as a secured-together bonded glove of multiple layers without using an air inflation method. The invention brings a surface of the first (liner) glove and second (exterior) glove together smoothly without resistance or wrinkling, resulting in no decreased comfort or function for the finished glove during use for glove purposes. The invention uses a slide-from-tip application apparatus and method to roll together the opposing surfaces of the liner glove and the exterior glove that has an open tacky adhesive coating for receiving the liner glove and bondingly securing the liner glove to the exterior glove upon cure. The present invention also uses a novel technique to apply an external pressure to facilitate bonding the multiple layers while heating to cure the adhesive coating. Also, a heating of the assembled glove helps to further melt the adhesive into a liner of a textile material and accelerate cross-linking and curing of the adhesive layer to bond the opposing surfaces. The adhesive requires about 24-72 hours to completely cure, but the heating helps to accelerate the process as well flow the adhesive for joinder of the opposing surfaces of the joined glove layers.

The present invention meets the need in the art by providing a glove comprising a first glove and a second glove of a protective material overlying the first glove. An adhesive coating layer intermediate the first glove and the second glove bondingly secures the first glove and the second glove together. The adhesive coating layer comprises a tacky adhesive with an open time between an application to the second glove and a cure, whereby the second glove, having received the application of the adhesive layer, rollingly receives respective portions of the first glove while tacky before cure.

In another aspect, the present invention provides a method of assembling a protective glove, comprising the steps of:

(a) positioning a first glove on a first form having five spaced-apart digital carriers;
(b) positioning a second glove on a second form;
(c) applying a coating of a long open tacky adhesive onto an outward surface of the second glove;
(d) moving the first form relative to the second form for rolling respective digital portions of the first glove onto aligned respective digital portions of the coated outer glove from a digital tip to a crotch portion thereof;
(e) moving a cuff portion of the first glove longitudinally past the crotch portions of the second glove for the second glove to contactingly receive a palm portion and the cuff portion of the first glove; and
(f) curing the tacky adhesive coating to bond the first glove to the second glove.

In another aspect, the present invention provides an apparatus for assembly of a glove, comprising a first form for receiving a first glove and having five spaced-apart digital carriers with each of the digital carriers receiving a respective digital portion of the first glove and a second form for receiving second glove. The first form attaches to a frame, and the first form is movable from a first position with the digital carriers remote from but aligned with respective digital portions of the second form to a second position with the digital portions of the first glove rollingly received on a respective digital portion of the second glove from a respective digital tip to a crotch portion of the second glove. Pulling a cuff portion of the first glove longitudinally past the respective crotch portions of the second glove brings a palm portion and the cuff portion of the first glove into contacting alignment with the second glove. An apparatus for applying a coating of a tacky adhesive with an open time on an outward surface of the second glove, whereby the adhesive coating bonds the first glove and the second glove together upon cure of the adhesive coating.

Objects, advantages, and features of the present invention will become apparent upon a reading of the following detailed description in conjunction with the drawings.

DETAILED DESCRIPTION

Figure 1:
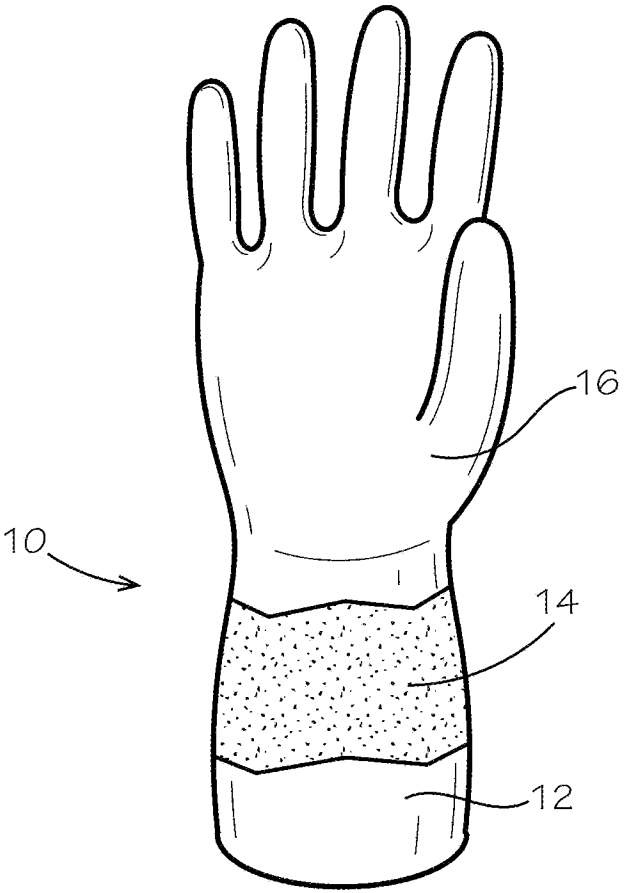
FIG. 1 illustrates a multi-layer glove in accordance with the present invention manufactured by rolling a liner onto a tacky adhesive layer coating of an exterior glove.

With reference to the drawings, in which like parts have like identifiers, FIG. 1 illustrates a multiple function glove 10 in accordance with the present invention. The glove 10 is shown with a first glove 12 rollingly received into contact with an open tacky adhesive coating 14 applied to a second glove 16 while the adhesive is open and before cure. The first glove 12 is referenced herein as an inner liner 12 that after assembly is disposed inwardly for use of the glove 10 for glove purposes. The second glove 16 is referenced herein as an exterior glove 16 disposed after assembly outwardly for glove purposes. As discussed below, the liner glove 12 and the exterior glove 16 are inverted during assembly, and thereafter the assembled glove 10 is reversed to position the exterior glove 16 outwardly and the liner 12 inwardly as illustrated. In an illustrative embodiment, the inner liner 12 is a fabric material for contacting a user's skin during wearing use of the glove. The present invention thus assembles the glove 10 by (a) attaching the liner glove 12 to the open adhesive layer 14 outwardly of the exterior glove 16 and (b) inverting the assembly to position the liner glove 14 inwardly and the exterior glove 16 outwardly.

The tacky adhesive coating 14 in accordance with the present invention has a long open period of tackiness between application of the adhesive coating to a surface of the exterior glove 16 held inverted on a form (discussed below) and a cure whereby the adhesive coating is no longer tacky but bonds the liner glove 12 and the exterior glove 16 together securely and uniformly. The assembly apparatus and the method disclosed herein advantageously rolls the liner glove into engaging contact with the open tacky surface of the adhesive coating as a first form holding the liner glove moves relative to a second form holding the exterior glove. The tacky adhesive coating having a long open period to cure enables smoothing of the liner glove to remove wrinkles during rolling attachment of the liner glove.

The tacky adhesive is a reactive hot melt adhesive that remains tacky for a long period from application to final cure, for example, of at least one minute, preferably to about 10 minutes, more preferably to about 60 minutes, and more preferably with a final cure to about 3 days. The tacky adhesive uses warm temperature application and ambient curing over an extended period (up to 3 days). The ambient curing may be facilitated in low ambient humidity (<50ˆ%) with supplemental moisture, to provide a bonding of the liner glove and the exterior glove. The cured bonding exhibits resistance to low and high temperatures, solvents, and moisture. A tacky adhesive useful with the present invention is TORA TT 1001 reactive hot melt adhesive available from Selic Corp Public Company Limited, of Bangkok, Thailand. Such tacky adhesive is a polyurathene having a viscosity of about 2,500 cps at 120° C., with an open time of between about 50 to 60 minutes, and complete cure within 1 to 3 days, applied at an operating temperature of about 100° C. to 170° C. Also, a heating of the assembled glove helps to further melt the adhesive relative to the liner glove, and accelerate cross-linking and curing of the adhesive layer to bond to the opposing surfaces of the liner glove and the exterior glove. For example, an embodiment makes the inner liner of a textile material and the heating of the assembled glove helps the adhesive to flow into the interstices of the textile material. The adhesive useful with the present invention with a long open time may take about 24 hours-72 hours to completely cure for bonding the opposing layers of the inner glove and the exterior gloves together, but the heating helps to accelerate the curing process as well as all facilitate uniform adhesive coverage over the surfaces, for example, of the textile portion in such embodiment.

Other multi-layer gloves may be similarly assembled. These include as examples and not limitation, exterior gloves manufactured for providing chemical resistance, woven fabrics that are cut-resistant, that offer thermal resistance. Work and industrial gloves find uses in a range of trade and industries requiring multiple features, including oil and refinery facilities, manufacturing, construction, heavy equipment operation and servicing, and surgical gloves requiring puncture resistance with fluids repellant or impermeable barrier. Multiple layer gloves may be assembled for particular industrial applications, such as a first layer of a textile material for positioning adjacent skin, a second layer of a temperature resistant material, and a third layer of an exterior working material for chemical and impact resistance.

The assembly apparatus and process inverts the glove layers 16, 12 for assembly. The exterior layer 16 is innermost during assembly and attachingly receives the inner layer 12 as a covering layer in contact with the adhesive coating 14. The assembly of the multiple layer glove 10 is then reversed inside-out for proper relation of the second glove exterior layer 16 outwardly and the first glove inner layer 12 inwardly, for glove use purposes.

The liner glove 12 loads onto a first form in a loading apparatus discussed below so that the desired surface to bond with the exterior glove 16 is outwardly of the apparatus. The liner glove 12 after positioning on the first form alternatively may be pre-treated with an adhesive or other material to assist in bonding. The loading apparatus includes a first form with five spaced-apart digital carriers that receive the respective fingers and thumb portions of the liner glove 12. (The term "digital carrier" refers to the portion of the loading apparatus that receives the thumb and finger portions of the liner glove 12. The term "thumb" refers to the first digit of a human hand, set apart and opposable to the other four digits of the hand and separated along a palm edge at finger crotches or gaps between the adjacent digits. Appendages such as fingers and thumbs are digits.)

Figure 2:
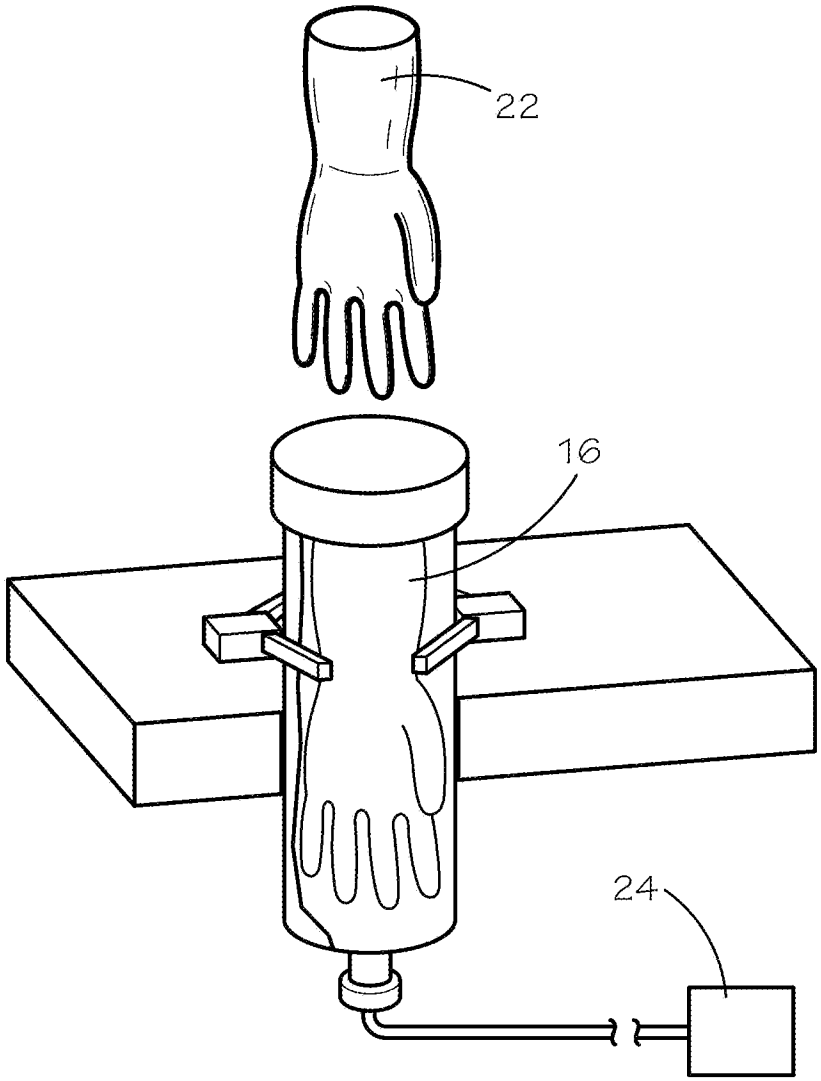
FIG. 2 illustrates a vacuum pipe that receives an exterior glove for installing on a first form for assembly of the multi-layer glove of the present invention.

The second glove, or exterior glove 16, is placed on a conforming former, or a second form 22, of the same size without wrinkling. The second form 22 has the structure of a human hand with fingers and thumb and forearm for conformingly receiving the exterior glove 16. FIG. 2 illustrates in partial cut-away view a vacuum pipe 20 secured to a work table by arcuate clamps. The vacuum pipe 20 receives the exterior glove 16 inwardly, for installing on the second form 22 for assembly of the multi-layer glove 10 of the present invention. The vacuum pipe 20 communicates with a pump 24 for pulling air from the pipe 20. The second (exterior) glove 16 inserts with digital portions of the fingers and thumb downwardly extending from a palm portion and opposing a longitudinal forearm portion that extends to a distal end cuff portion. A portion of the forearm and cuff portion at the distal end overlaps an upper edge and upper outside portion of the pipe 20 to hold the exterior glove 16 within the vacuum pipe 20. Operation of the pump 24 extracts air from the pipe 20 and pulls the exterior glove 16 open. The second form 22 sized for the exterior glove 16 and with spaced digital portions, inserts into the open glove 16 for positioning the glove on the second form. The digital portions of the glove 16 receive the digital portions of the form 22. The pump is stopped and the glove 16 seats closely on the second form 22.

Next, the adhesive 14 featuring a long open period for cure, such as a hot melt, water-based, or solvent-based adhesive, is applied to the outer glove 16 held on the second form 22. The available methods typically includes spray, dip, or brush application. (After assembly of the inner glove 12 onto the open adhesive coating 14 on the exterior glove 16, the adhesive then dries or cures, by either air or heat to remove moisture and bond the opposing liner glove 12 and the exterior glove 16 together.)

The loading apparatus with the first form carrying the liner glove 12 is positioned to align the digital carriers with the digital extensions of the second form 22. The loading apparatus is moved downwardly, to engage the first glove 12 (liner glove 12) with the second glove 16 (exterior glove 16). The loading apparatus is pushed down, to engage the distal end of the respective digital carriers with the respective digital extension of the second form. This brings the liner glove 12 into contact with the adhesive coating 14, starting with the respective finger tips. Continuing the relative movement, the digital carriers move towards the palm portion. As each digital carrier moves, the carried portion of the liner glove rolls onto the coated digital portion of the exterior glove 16. The inner passageway defined by the digital carrier receives the respective digital portion of the second form 22. This moving/rolling placement of the respective portions of the liner 12 onto contacting attachment to the exterior glove 16 continues towards the palm portion. This relative movement of the digital carrier applies and rolls the liner outwardly of the digital carrier onto and overlying the receiving portions in the respective digital portions of the exterior glove starting from the finger tips down to and proximately past the finger crotch. The long open adhesive holds the liner glove but yet allows slight adjusting by a technician of the respective portions of the liner to smooth wrinkles during application of the liner glove positioning in alignment with respective portions of the exterior glove.

Once the first form moves past the digital crotches (the lateral edges of the palm between adjacent fingers and thumb), the cuff portion of the liner is pulled over the respective forearm portion of the glove 16 on the second form 22. This thereby inverts the remaining portions of the liner glove 12 as a transfer step to move into contacting engagement with the glove 16 for positioning the palm portion, the forearm portion, and the cuff portion in adhering contact between the liner and the exterior gloves.

The assembled exterior glove 16 and liner 12 are thereby attached together by the long open adhesive coating. Minor and slight relative movement of the liner 12 may be accomplished to remove wrinkles and smooth the liner. The assembly of the glove 10 is then allowed to cure whereby the bonding of the adhesive secures the multi-layers together.

In an alternate practice of the assembly process, a pressure layer maybe installed to apply compression onto the glove surface to push the liner 14 firmly and uniformly against the exterior glove 16 held on the second form 22. The pressure layer in an embodiment consists of a tight resilient glove of similar shape, such as a rubber glove or a resilient textile glove. The pressure layer is installed on the second form including the respective digital carriers. The second form is then moved to roll the pressure layer over the liner 14 in the manner discussed above from the digital (finger and thumb) tips to the palm and further through the forearm and cuff portions. The pressure layer as a conforming glove shape applies continuous pressure on the liner pressing the liner against the receiving exterior glove layer. The pressure provided from the pressure layer has a modulus of about 5 to 15 megapascals at 100% elongation.

In an alternate practice, the firm contacting of the liner 12 to the exterior glove 16 during curing is accomplished by placing the assembled glove in a pressure vessel and applying vacuum compression for a period sufficient for cure of the adhesive to securely bond the multiple layers. The pressure vessel may comprise a vacuum poly bag.

In an alternate aspect of the assembly process, the assembled glove product may be heated to a temperature, normally 70° C. to 150° C., to induce the adhesive coating to cure. The curing adhesive and (alternatively, under pressure), the exterior glove 16 and the inner liner 14 adhere and bond securely together. The heating step occurs for a short period of time, of about 30 to 180 seconds, to ensure complete and secure bonding. A target temperature of the bonding surfaces during such curing event is typically 50° C. to 130° C. An oven preheated to about 70° C. to 170° C. facilities this alternative curing for the adhesive coating to bond the layers securely. The assembled product is then cooled to ambient, typically room, temperature or through accelerated cooling, such as by cooled air or a cool water bath, to harden the adhesive and prevent separation. Typically, the target cool down temperature is between 25° C. to 50° C.

In an alternative, a "fast cool" bath may be gainfully used to reduce the adhesive temperature to below 20° C., thus increasing the viscosity and hardness. This allows removal of the assembled glove 16 from the second form 22 without disrupting the adhesion bonding of the opposing layers. However, the wrist area may experience elongation such as up to about 50%, when pulled over the thumb and can result in wrinkling if the adhesive coating 14 is too fluid or of a low viscosity.

The pressure glove layer (if used) is removed. The finished assembled glove 10 is then removed from the second form 22. This may be accomplished by rolling the glove 10 off of the first form. Alternatively, a supplemental assist of pressurized air may be directed between the second form 22 and the exterior glove 16 to assist straight-off removal. The assembled finished glove 16 is then re-verted to position the multi-layer assemble with the exterior glove 16 outwardly as shown in FIG. 1 for use of industrial and work glove purposes.

The liner loading apparatus consists of a pipe or multiple spaced-apart bars defining passageway for receiving the digital extensions of the second form 22, with or without rollers to allow the liner 12 to slide or roll smoothly across the surface of the pipe while the liner loading apparatus moves relative to the exterior glove 16 held on the second form 22, and thereby cause the liner to contact the coating layer 14 for attaching to the exterior glove, which liner inverts during application.

Figure 3:
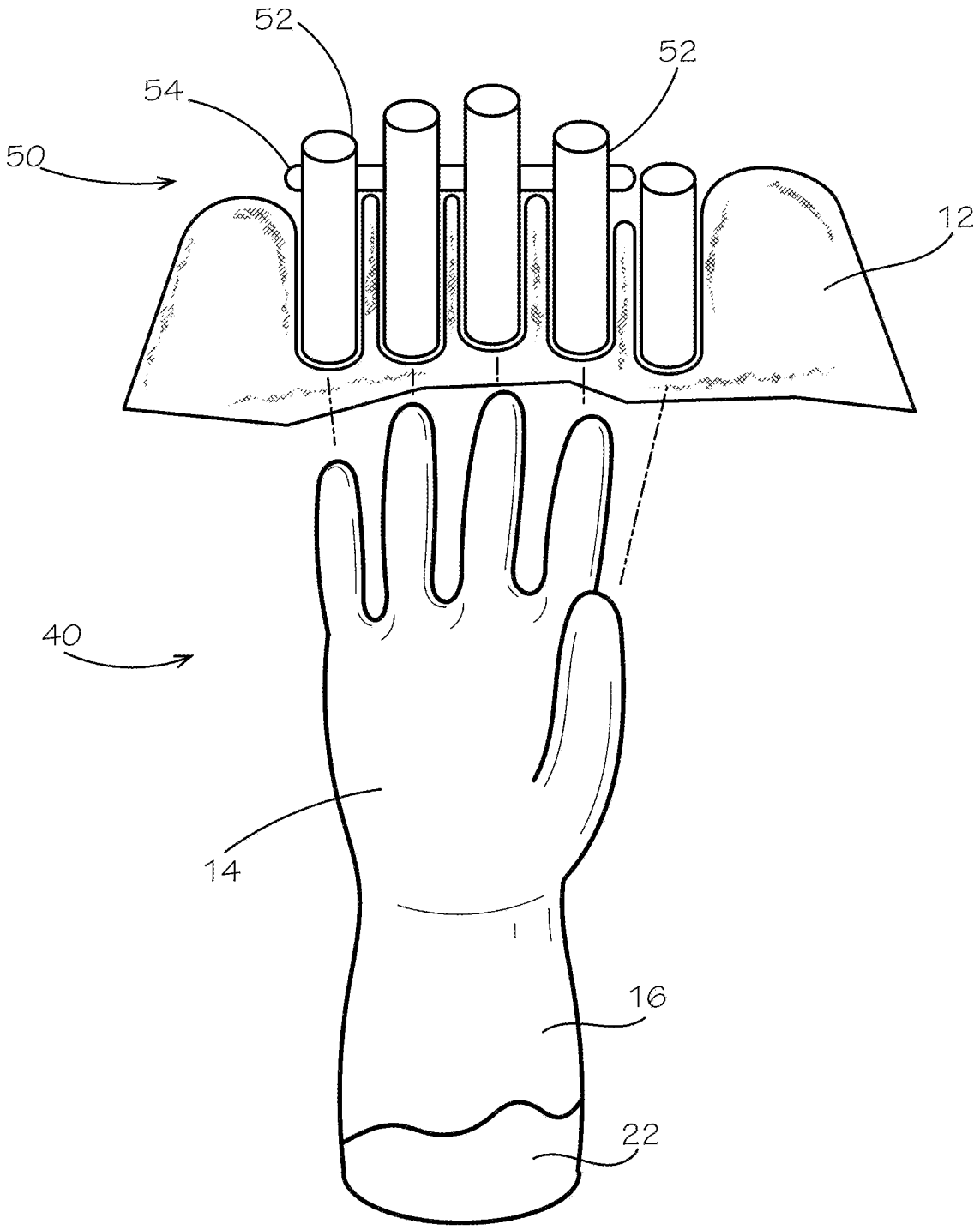
FIG. 3 illustrates a first embodiment of an apparatus for assembly of a multi-layer glove in accordance with the present invention.

FIG. 3 illustrates a first embodiment of an apparatus 40 for assembly of a multi-layer glove 10 in accordance with the present invention. The apparatus 40 includes the second form 22 for receiving and holding the outer glove 16. The form 22 has five digital members corresponding to a thumb and four fingers of a human hand and configured for left hand or right hand glove assembly. The digital members extend from a palm portion. A forearm portion extends oppositely from the palm potion to a cuff portion. The second form 22 is sized for receiving and holding the exterior glove 16 with its respective digit portions, palm portions, and extending forearm and cuff portions covering the first form. The outer layer glove 16 is inverted and placed on the second form 22. The exterior glove 16 is smoothed on the second form 22 to remove wrinkles. The exterior glove may be installed on the form 22 using the vacuum pipe 20 discussed above in reference to FIG. 2. The exterior glove 16 is positioned with the digital members downwardly in the pipe 20 with the cuff portion overlapping an upper distal edge and proximate outside surface. Upon operation of the vacuum, the exterior glove 16 is opened in the pipe 20 with the digital portions pulled by the vacuum downwardly. The form 22 then inserts into the open cuff end with the digital members downwardly for receiving the glove 16 and the digital portions. The vacuum is turned off and the form 22 carrying the glove 16 is removed from the cylinder. The exterior glove 16 is smoothed relative to the form 22 to remove wrinkles.

With continuing reference to FIG. 3, the loading apparatus further includes a first form 50 that carries the liner glove 12. In a first embodiment, the first form 50 comprises five digital carriers 52 that receive a respective one of the digital portions of the liner glove 12. The digital carriers 52 in the first embodiment are elongated tubes sized for sliding longitudinally onto a respective digital member of the second form 22. The open tubes 52 define passageways for receiving the respective digital member. The tubes extend to a distal tip end of the digital portions and extend outwardly as the palm and forearm portions extend laterally away. A connector structure generally 54 may hold the five digital carriers 52 in spaced-relation. The first form 50 receives the digital potions of the inner glove 12 on the respective digital carriers 52.

The glove 16 assembles by aligning the five digital carriers 52 of the first form 50 with the five digit members extending from the second form 22. The digital carriers 52 move relative to the second form 22 between a first position aligned with and spaced from the second form 22 and a second position with the digital carriers 52 engaging and receiving the digital members in the respective passageways of the tubes that define the digital carriers. During movement, each digital carrier 52 receives inwardly a respective digital member of the second form 22. The inner liner 12 carried outwardly on the digital carriers 52 moves rollingly onto the coated exterior glove 16 as the distal end of the respective tube (or digital carrier) moves longitudinally on the digital member towards the palm portion. The inner liner 16 rolls from the distal end of the digital carrier 52 and contacts and attaches to the adhesive coating 14. The distal ends of the digital carriers reach the crotches between the adjacent digital portions of the exterior glove 16 on the second form 22. The cuff at the distal end of the forearm of the liner 12 is then pulled over the palm portion of the second form 22 and extended relative to the second form 22 to bring the palm portion and the forearm portion of the liner glove 12 into contact with respective portions of the exterior glove 16 held on the second form. The coating layer 14 bonds the liner glove 12 to the exterior glove 16. Upon cure as discussed above, the assembled glove 10 is removed from the second form 22.

Figure 4:
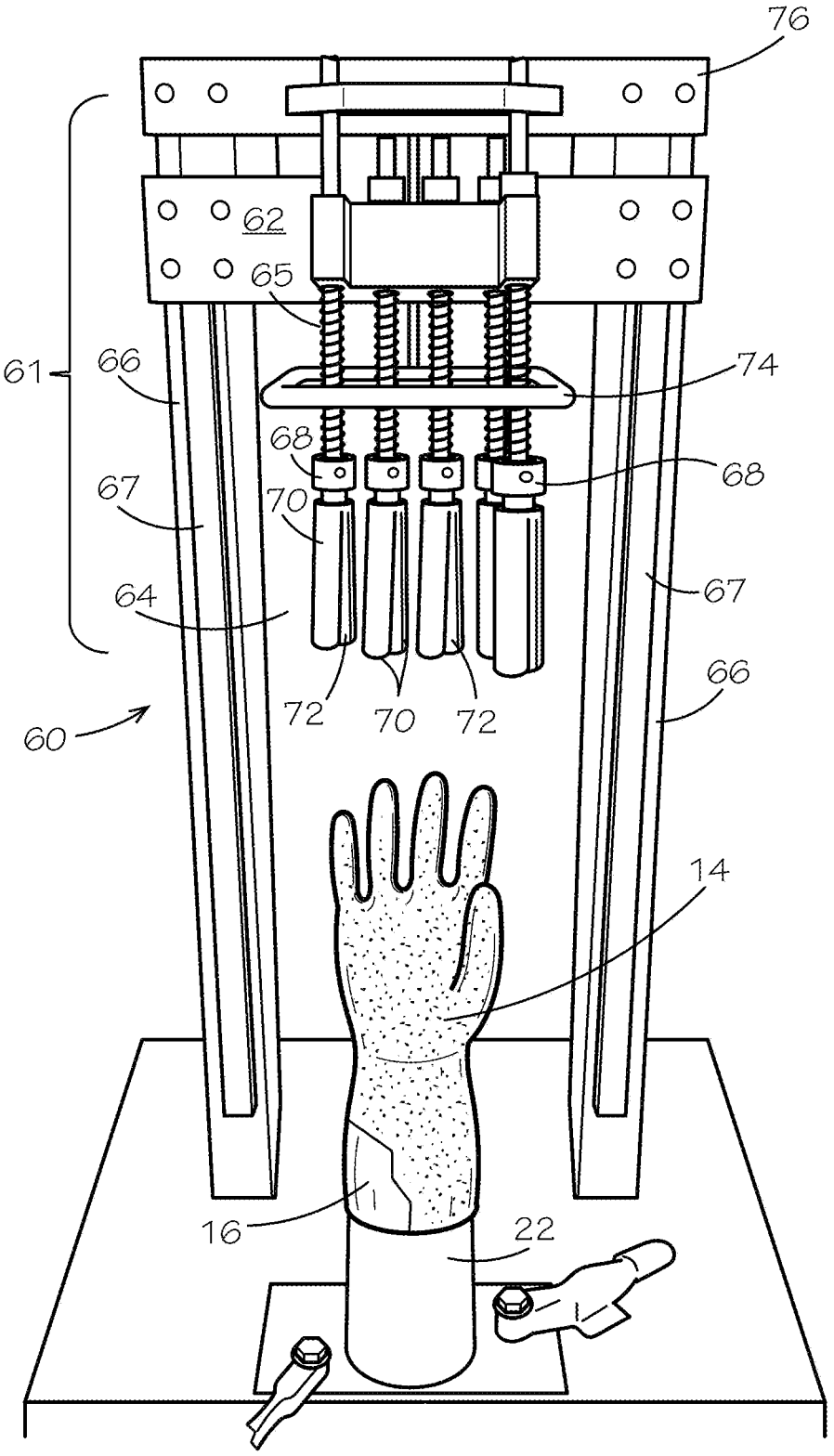
FIG. 4 illustrates a second embodiment of an apparatus for assembly of a multi-layer glove in accordance with the present invention.
Figure 7:
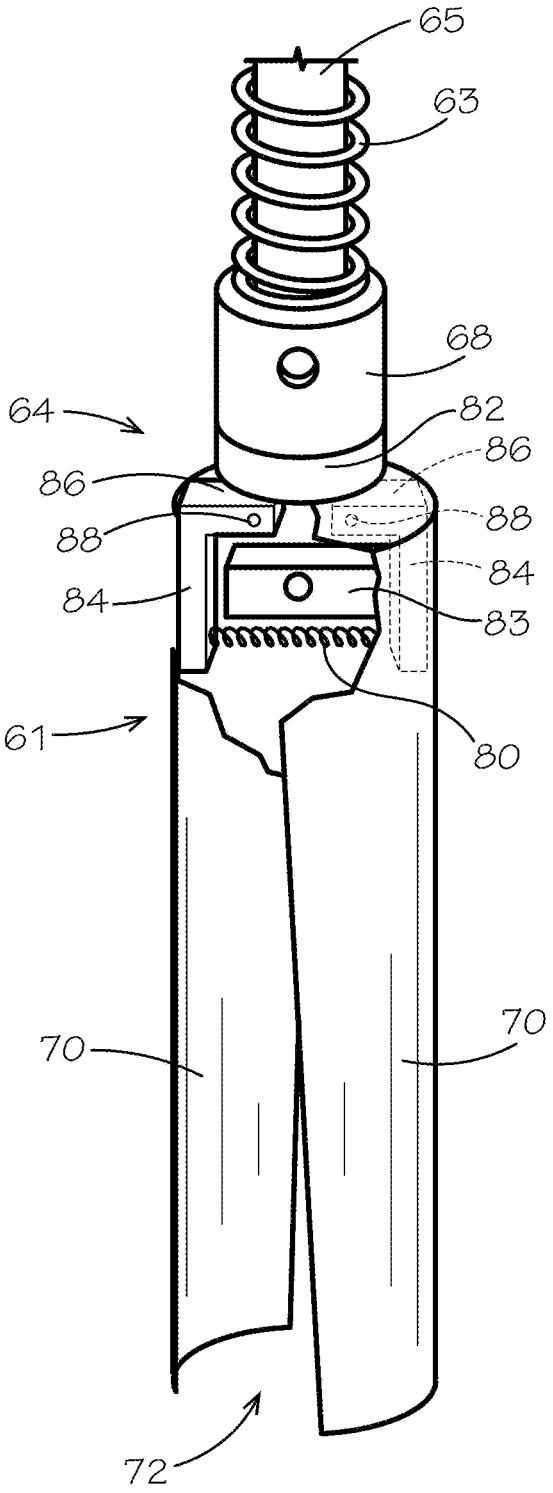
FIG. 7 illustrates in cut-away detailed view an embodiment of the digital carrier for the first form according to the present invention.

FIG. 4 illustrates a second embodiment of an apparatus 60 for assembly of a multi-layer glove 10 in accordance with the present invention. The apparatus 60 includes the second form 22 discussed above for holding the exterior glove 16 for receiving the liner glove 12. A first form generally 61 comprises a support 62 for five digital carriers 64. The support 62 attaches to a frame 66 extending vertically from a base on which the second form 22 positions. In the illustrated embodiment, a track 67 attaches to the frame 66. The support 62 moves on the track 67 between a first position vertically spaced from the second form 22 to a second position for transferring the liner glove 12 onto the exterior glove 16. The five digital carriers 64 receive respective digit portions of the exterior glove 16 during movement to the second position. Each digital carrier 64 includes an elongate shaft 65 that secures to the support, as shown in the illustrated embodiment to a frame attached to the movable support 62. The shaft 65 receives a spring 63 to bias the digital carrier 64 extended downwardly. A connecting member 68 attaches such as with a threaded fastener 71 to a distal end of the shaft 65. A pair of opposing U-shaped channel members 70 pivotally attach at respective first ends to the connecting member 68. The opposing channel members 70 define a passageway 72 therebetween for receiving a respective digital member of the second form 22. A spring 80 (as shown in FIG. 7) connects between the opposing channel members 70 to bias the channel members towards each other. The pivotable connection of the channel members 70 allow the channel members to move outwardly while the digital carrier 64 moves to the second position for contacting engagement of the liner glove 12 with the coating 14 of the exterior glove 16 held on the second form 22 as the digital member of the second form moves inwardly in the passageway 72. The passageway 72 thereby receives the digital member therein.

Figure 8:
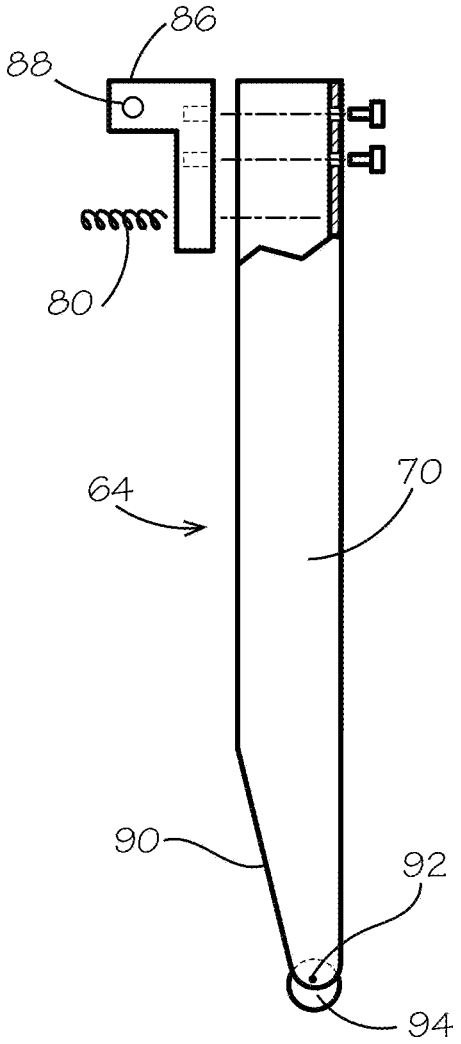
FIG. 8 illustrates an exploded detailed side view of the digital carrier illustrated in FIG. 7.

FIG. 7 illustrates in cut-away detailed view an embodiment of the digital carrier 64 for the first form 61 according to the present invention. The opposing channel members 70 pivotally connect at first ends relative to the shaft 65. In the illustrated embodiment, the connector 68 attaches to the shaft and the channel members 70—pivotally attach to the connector 68. The connector 68 has spaced-apart legs 82. A support 83 holds the legs 82 spaced-apart. Each channel member connects to an L-shaped support 84 that seats inwardly with a lateral arm 86 extending between the legs 82 of the connector 68. As shown in FIG. 8, a pair of fasteners 83 secure the support 84 to the channel member 70. A pin or threaded fastener extends through an opening in the leg 82 and engages a receiving socket 88 in the arm 86 to pivotally couple the channel member 70 to the connector 68. The spring 80 attaches to opposing faces of the support 84 to bias the channel members 70 together.

FIG. 8 illustrates an exploded detailed side view of the digital carrier 64 illustrated in FIG. 7. In the illustrated embodiment, an edge 90 of the channel member 70 tapers from intermediate opposing ends to the distal end. The tapered edge 90 facilitates accommodating entry of the digital portion of the second form 22 into the passageway 72. Further, in an alternate embodiment, the channel member 70 holds an axle 92 disposed transverse between the opposing edge portions. The axle 92 holds a roller 94. The roller 94 rotates during downward movement of the first form 62 relative to the second glove 16 held on the second form 22. The roller 94 guides the rolling movement of the digital portion of the first glove 12 into contact with the adhesive coating 14. In an alternate embodiment, a series of spaced-apart axles holding rollers are positioned in longitudinally spaced relation between the distal end and proximate the L-shaped support 84, to guide the distal portion of the second form 22 in the passageway 72 during relative movement of the first and second forms 61, 22.

With continued reference to FIG. 4, an arcuate hoop 74 attaches to a second support 76. The hoop 74 holds the forearm and cuff portion of the liner glove 12 outwardly of the digital portions received on the digital carriers 64, as best shown in detail cut-away view in FIG. 6.

Figure 6:
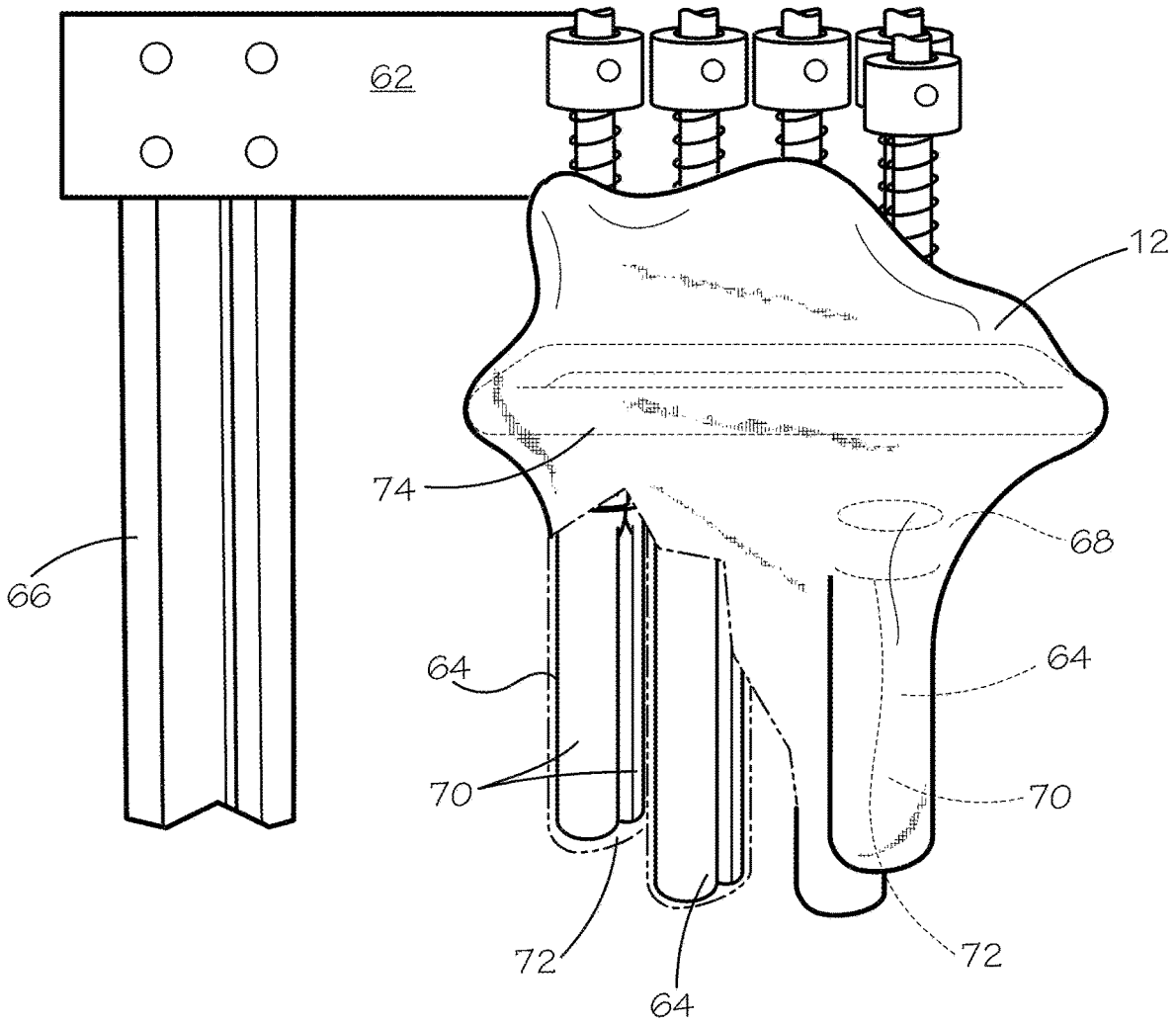
FIG. 6 illustrates a detailed view of the digital carriers holding the liner glove.

As shown in detail view in FIG. 6, the liner glove 12 is positioned on the second form 61 with the digital portions received by a respective one of the digital carriers 64. A distal end of each channel member 70 seats proximate an interior extent or tip of a respective digital portion of the liner glove 12. The forearm and cuff portion of the liner glove 12 extends outwardly and over hoop 74.

Figure 5:
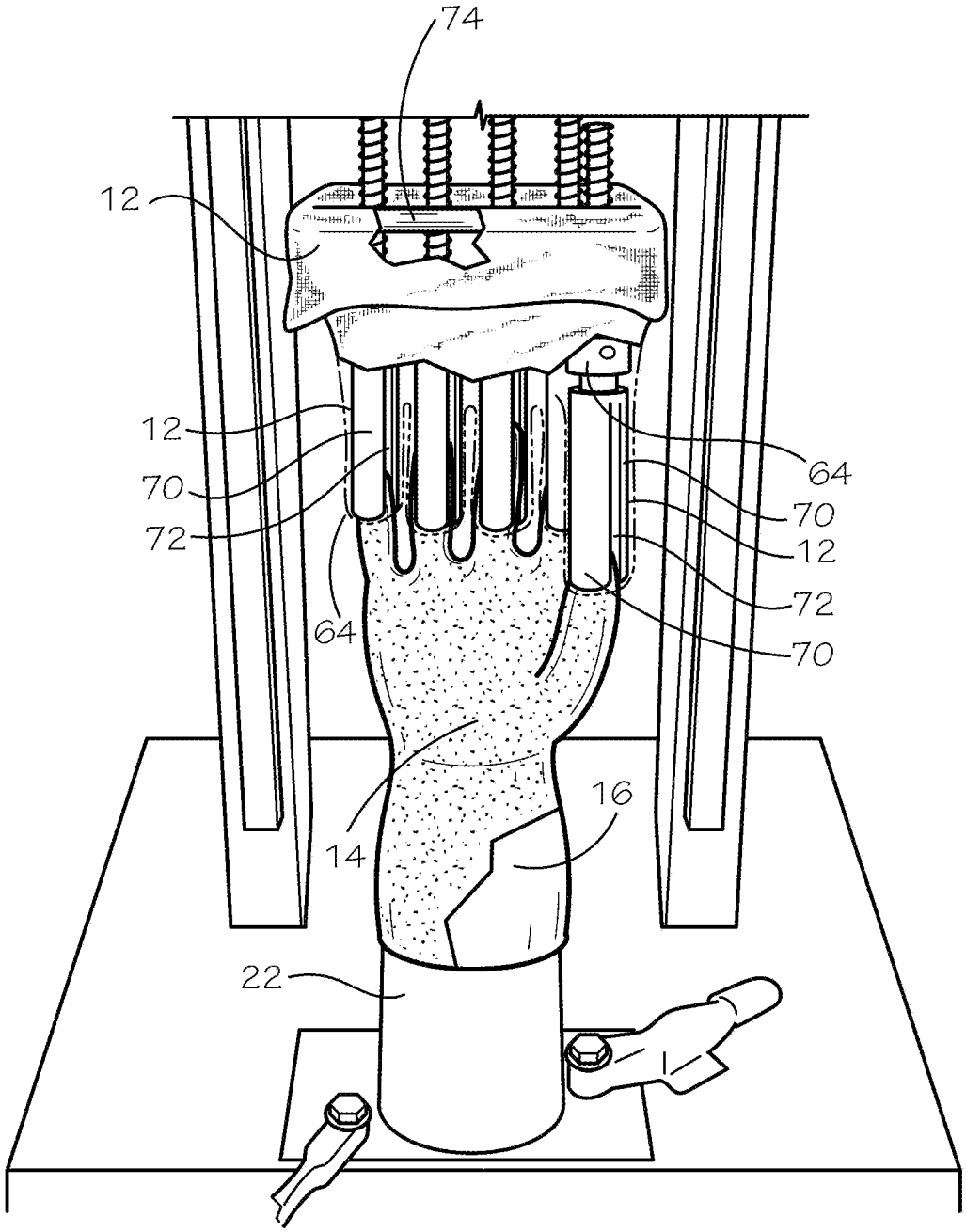
FIG. 5 illustrates a detailed view of the digital carriers holding digital portions of the liner glove and the digital carriers splaying apart while moving relative to the exterior glove for rolling the digital portions into contact with the tacky adhesive layer coating the exterior glove during movement of the digital carrier relative to the exterior glove.

With continuing reference to FIG. 4, the second form 22 stands vertically lower than the support 62 whereby the digital members align with the digital carriers 64. The support 62 moves vertically relative to the second form 22 to bring the digital carriers 64 into receiving position relative to the respective digital members of the second form 22, as illustrated in FIG. 5. The digital members enter into the respective passageways 72 between the opposing U-shaped channel members 70. The channel members 70 are pivotally attached at upper ends, and during movement of the support downwardly, the channel members move outwardly to facilitate receiving the digital members of the second form 22 in the passageway 72 therebetween. As the digital carriers 64 receive the digital members (having the respective portions of the coated exterior glove 16), the downward movement causes the digital portions of the liner glove 12 to roll into contact with the coating 14 and thereby bond to the exterior glove 16 held on the second form 22. As the support 62 continues to move, the contacting liner 12 may be slightly adjusted relative to the exterior glove 16 to remove wrinkles and smooth the engagement in the long open tacky adhesive coating 14. The movement of the support 62 stops when the distal ends of the digital carriers 64 reach the finger crotches at the palm portion. The cuff and forearm portion of the liner glove 14 then is moved inwardly off of the hoop 74 and downwardly past the palm to align respective palm and forearm portions of the liner glove 12 in contacting relation with the exterior glove 16. Upon cure as discussed above, the assembled glove 16 is removed from the second form 22.

The following succinctly characterizes features disclosed of the of the present invention of the assembled glove, the apparatus for assembly of the glove, and the process for assembly of the glove.

1A. A glove with multiple layers with separate functions.

1B. The glove of paragraph 1A, wherein an outer layer provides a chemical resistant function.

1C. The glove of paragraph 1A, wherein an outer layer provides an abrasion resistant function.

1D. The glove of paragraph 1A, wherein one or more inner layers include a cut resistant textile liner.

1E. The glove of paragraph 1A, wherein one or more inner layers include a thermal resistant textile liner.

2A. An apparatus to apply an inner layer to an outer glove easily and free from wrinkles.

2B. The apparatus of paragraph 2A, wherein a series of smooth pipes carries each finger or digit, each with a length of 3 inches to 18 inches and a diameter of ¾ inch to 2 inches, used to invert the liner over the receiving outer layer without wrinkles.

2C. The apparatus of paragraph 2B, wherein the pipes are spliced in half or more to allow the pipes to open and close along a travel of the finger or digit and palm surfaces of the outer glove.

2D. The apparatus of paragraph 2C, wherein a spring is attached to the upper part of the spliced pipes to keep the pipe surfaces near the receiving outer glove surface during application of the inner glove thereto.

2E. The apparatus of paragraph 2B, wherein an end roller, with a 1 mm to 15 mm diameter, is attached to roll the textile liner and allow for smooth inversion.

2F. The apparatus of paragraph 2B, further comprising multiple rollers, with a 1 mm to 15 mm diameter, positioned along the pipes or rods to assist in rolling the textile liner during inversion application 2G. The apparatus of paragraph 2A, wherein a series of smooth rods for each finger are used to invert the liner over the receiving outer layer without wrinkles.

2H. The apparatus of paragraph 2G, wherein an end roller is attached to roll the textile liner and allow for smooth inversion.

2I. The apparatus of paragraph 2G, wherein multiple rollers are positioned along the pipes or rods to assist in rolling the textile liner during inversion application 3A. The use of a pressure layer to add constant force to the multiple layers during the bonding process.

In embodiments for which a working exterior surface of the exterior glove 16 exterior differs from the opposing glove surface, such as by treatment, texturizing, embossing, impact resistant projections, or other differentiating structure, the outer glove is positioned inverted on the first form so that such exterior surface is inwardly relative to the first form.

Multiple layer gloves may readily be assembled with the foregoing disclosed apparatus and method. For example, a glove may have a chemical resistance exterior glove layer and work requirements call for the glove to also have cut resistance. A first liner formed of a cut resistant fabric such as woven metallic threads may first be received on the coated adhesive layer on the exterior glove held on the first form. The coating may exude through the weave, or alternatively, additional adhesive may be applied as a coating on the received first liner. After assembly, a second first liner of a cloth fiber weave may than be installed in overlying contacting relation to the first liner of the assembled glove using the assembly apparatus discussed above, for an assembled three-layer glove.

Further, the apparatus and method of the present invention readily provides for assembly of industrial gloves in which each layer enables one or more protective properties. In the illustrative embodiment of FIG. 1, the first glove 12 is a fabric liner for skin contact but may be a material having particular other protective properties in addition to wearability comfort; for example, cut protection, puncture resistance, thermal protection, liquids impermeability, or other. The second, or exterior, glove typically features a chemical protection property, but may also have other protective properties; for example, puncture resistance, impact resistance, liquids impermeability, reflective coloring for altering others to the worker's presence, or other protective property.

It thus is seen that an apparatus and process for assembly of multi-layer liner and exterior gloves is now provided which overcomes problems associated with the prior art. While this invention has been described in detail with particular references to the preferred embodiments thereof, it should be understood that many modifications, additions, and deletions, in addition to those expressly recited, may be made thereto without departure from the spirit and scope of the invention recited in the following claims.

What is claimed is:

1. A method of assembling a protective glove, comprising the steps of:

(a) positioning a first glove on a first form having five spaced-apart digital carriers;

(b) positioning a second glove on a second form;

(c) applying a coating of a long open tacky adhesive onto an outward surface of the second glove;

(d) moving the first form relative to the second form for rolling respective digital portions of the first glove onto aligned respective digital portions of the coated second glove from a digital tip to a crotch portion thereof;

(e) moving a cuff portion of the first glove longitudinally past the crotch portions of the second glove, whereby the second glove contactingly receives a palm portion and the cuff portion of the first glove; and (f) curing the tacky adhesive coating to bond the first glove to the second glove.

2. The method of assembling a protective glove as recited in claim 1, further comprising the step of moderating a rate of cure of the long open tacky adhesive by applying an aqueous mist thereon before the second glove receives the first glove.

3. The method of assembling a protective glove as recited in claim 1, wherein the coating adhesive comprises a polyurethane having a viscosity of about 2,500 cps at an application temperature.

4. The method of assembling a protective glove as recited in claim 3, wherein an application temperature of the coating adhesive is in a range of about 100 °C-170 °C.

5. The method of assembling a protective glove as recited in claim 1, further comprising the step of pressing inwardly on the first glove against the second glove together for bondingly connecting the first glove to the second glove with the cured coating adhesive.

6. The method of assembling a protective glove as recited in claim 5 wherein the pressing step comprises applying a pressure inwardly onto the first glove.

7. The method of assembling a protective glove as recited in claim 1, wherein the second glove is formed of a protective material.

8. The method of assembling a protective glove as recited in claim 7, wherein the protective material is selected from a group consisting of a chemical resistant material, a cut resistant material, a material for thermal protection, a liquid impermeable material, a liquid resistant material, an abrasion resistant material, a puncture resistant material, and a tear resistant material.

9. The method of assembling a protective glove as recited in claim 7, wherein the protective material is selected to feature one or more of a group consisting of resistance to chemicals, resistance to cutting, resistance to cold temperatures, resistance to hot temperatures, resistance to liquids, resistance to abrasion, resistance to puncture, resistance to tearing, impermeable to liquids, moisture absorbent, and moisture wicking.

10. The method of assembling a protective glove as recited in claim 1, wherein the first glove comprises a protective material selected from a group consisting of a chemical resistant material, a cut resistant material, a material for thermal protection, a liquid impermeable material, a liquid resistant material, an abrasion resistant material, a puncture resistant material, and a tear resistant material.

11. The method of assembling a protective glove as recited in claim 1, wherein the protective layer provides a chemical resistant function.

12. The method of assembling a protective glove as recited in claim 1, wherein the protective layer provides an abrasion resistant function.

13. The method of assembling a protective glove as recited in claim 1, wherein the second glove comprises a cut resistant textile material.

14. The method of assembling a protective glove as recited in claim 1, wherein the second glove comprises a thermal resistant textile material.

15. The method of assembling a protective glove as recited in claim 1, further comprising the step of heating the glove to about 70 °C to 150 °C for 30 to 180 seconds during the curing of the adhesive coating.

16. The method of assembling a protective glove as recited in claim 15, wherein the glove is heated in an oven preheated to about 70 °C to 150 °C.

17. The method of assembling a protective glove as recited in claim 1, further comprising the steps of (i) overlying the first glove with a pressure glove, and (ii) pressing the first glove against the second glove during curing.

18. The method of assembling a protective glove as recited in claim 17, wherein the pressure glove applies a pressure with a modulus of 5 to 15 megapascals at 100% elongation.

19. An apparatus for assembly of a glove, comprising:

a first form for receiving a first glove and having five spaced-apart digital carriers with each of the digital carriers receiving a respective digital portion of the first glove;

a second form for receiving a second glove;

a frame to which the first form attaches, said first form movable from a first position with the digital carriers remote from but aligned with respective digital portions of the second form to a second position with the digital portions of the first glove rollingly received on a respective digital portion of the second glove from a respective digital tip to a crotch portion of the second glove, whereby pulling a cuff portion of the first glove longitudinally past the respective crotch portions of the second glove brings a palm portion and the cuff portion of the first glove into contacting alignment with the second glove; and an applicator for applying a coating of a tacky adhesive with an open time on an outward surface of the second glove, whereby the adhesive coating bonds the first glove and the second glove together upon cure of the adhesive coating.

20. The apparatus for assembly of a glove as recited in claim 19, further comprising a device for pressing the first glove inwardly against the second glove together after assembly.

21. The apparatus for assembly of a glove as recited in claim 19, further comprising a roller attached proximate a distal end of a respective digital carrier for rolling the digital portion of the first glove into contact with the respective digital portion of the second glove.

22. The apparatus for assembly of a glove as recited in claim 19, wherein each of the digital carriers comprises an open-end tube sized to receive a respective digital portion of the second form, whereby the tube moving relative to the digital portion rolls the digital portion of the first glove into contact with the digital portion of the second glove.

23. The apparatus for assembly of a glove as recited in claim 19, wherein each of the digital carriers comprises:

an elongated rod;

a support at a distal end of the elongated rod;

at least a pair of fingers U-shaped in cross-section disposed in opposing spaced-apart relation to define a channel therebetween to receive a respective digital portion of the second form therein, the pair of fingers pivotally attached at a first end to the support, whereby the fingers move apart while receiving a respective digital portion of the second form inwardly in the channel by the moving of the first form relative to the second form to roll the digital portion of the first glove on the first form into contact with the digital portion of the second glove on the second form.

24. The apparatus for assembly of a glove as recited in claim 23, wherein the fingers are pivotally biased towards each other by a spring.

* * * * *